US007942143B2

(12) United States Patent
Lee et al.

(10) Patent No.: US 7,942,143 B2
(45) Date of Patent: May 17, 2011

(54) HEATING COOKING APPLIANCE AND BURNER SYSTEM THEREOF

(75) Inventors: Dae Rae Lee, Gimhae-si (KR); Jung Wan Ryu, Changwon-si (KR); Dae Bong Yang, Jinhae-si (KR); Sang Min Lyu, Changwon-si (KR); Yong Ki Jeong, Busan (KR); Young Soo Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 149 days.

(21) Appl. No.: 11/925,583

(22) Filed: Oct. 26, 2007

(65) Prior Publication Data

US 2008/0149093 A1 Jun. 26, 2008

(30) Foreign Application Priority Data

Dec. 20, 2006 (KR) ..... 10-2006-0130613
Jan. 23, 2007 (KR) ..... 10-2007-0007102

(51) Int. Cl.
*F24C 3/00* (2006.01)

(52) U.S. Cl. ..... 126/39 E; 126/39 R; 126/39 J; 431/354

(58) Field of Classification Search ..... 126/39 R–39 M, 126/39 H, 39 J, 39 K, 39 N; 431/354, 226, 431/328, 329, 266
See application file for complete search history.

(56) References Cited

U.S. PATENT DOCUMENTS

| | | | | | |
|---|---|---|---|---|---|
| RE20,662 | E | * | 2/1938 | Schneider | 126/39 R |
| 3,368,605 | A | * | 2/1968 | Reed | 431/353 |
| 3,468,298 | A | * | 9/1969 | Teague, Jr. et al. | 126/39 J |
| 3,606,612 | A | * | 9/1971 | Reid, Jr. | 431/281 |
| 3,633,562 | A | * | 1/1972 | Morse et al. | 126/39 J |
| 3,785,364 | A | * | 1/1974 | Reid et al. | 126/39 J |
| 4,083,355 | A | * | 4/1978 | Schwank | 126/39 J |
| 4,580,550 | A | * | 4/1986 | Kristen et al. | 126/39 J |
| 4,830,602 | A | * | 5/1989 | Kaselow | 431/80 |
| 5,024,209 | A | * | 6/1991 | Schaupert | 126/39 H |
| 5,295,476 | A | * | 3/1994 | Herbert | 126/39 G |
| 5,509,403 | A | * | 4/1996 | Kahlke et al. | 126/39 E |
| 5,549,100 | A | * | 8/1996 | Heisner et al. | 126/39 J |
| 5,833,449 | A | * | 11/1998 | Knight et al. | 431/191 |
| 6,067,980 | A | * | 5/2000 | Kahlke et al. | 126/214 R |
| 6,076,517 | A | * | 6/2000 | Kahlke et al. | 126/39 J |
| 6,299,436 | B1 | * | 10/2001 | Huang | 431/354 |
| 6,318,993 | B1 | * | 11/2001 | Huang | 431/354 |
| 7,481,210 | B2 | * | 1/2009 | Kim et al. | 126/39 B |
| 7,721,726 | B2 | * | 5/2010 | Lee et al. | 126/39 H |
| 2005/0142509 | A1 | * | 6/2005 | Kim et al. | 431/127 |
| 2006/0040228 | A1 | * | 2/2006 | Kim et al. | 431/329 |
| 2006/0048767 | A1 | * | 3/2006 | Lee et al. | 126/214 R |
| 2006/0070616 | A1 | * | 4/2006 | Lee et al. | 126/299 D |

(Continued)

FOREIGN PATENT DOCUMENTS

GB 288526 * 8/1928

(Continued)

*Primary Examiner* — Steven B McAllister
*Assistant Examiner* — Desmond Peyton
(74) *Attorney, Agent, or Firm* — Birch, Stewart, Kolasch & Birch, LLP

(57) ABSTRACT

A heating cooking appliance and a burner system thereof are provided. The height of the burner pot is reduced to facilitate product installation and reduce overall material and shipping costs. To increase user satisfaction with the product, a plurality of mixing tubes are extended in the same direction on one side of the burner pot in the burner system.

23 Claims, 13 Drawing Sheets

U.S. PATENT DOCUMENTS

2006/0076005 A1* 4/2006 Kim et al. ..... 126/214 R
2006/0078836 A1* 4/2006 Kim et al. ..... 431/12
2006/0147861 A1* 7/2006 Czajka et al. ..... 431/278
2006/0254574 A1* 11/2006 Lee et al. ..... 126/39 R
2008/0050687 A1* 2/2008 Wu ..... 431/354

FOREIGN PATENT DOCUMENTS

WO WO-2006/053540 A1 5/2006

* cited by examiner

HEATING COOKING APPLIANCE AND BURNER SYSTEM THEREOF

CROSS-REFERENCE TO RELATED APPLICATIONS

The present application claims priority under 35 U.S.C. 119 and 35 U.S.C. 365 to Korean Patent Application No. 10-2006-0130613 (filed on Dec. 20, 2006) and Korean Patent Application NO. 10-2007-0007102 (filed on Jan. 23, 2007), which are hereby incorporated by reference in its entirety.

BACKGROUND

The present disclosure relates to a heating cooking appliance, and more particularly, to a heating cooking appliance and a burner system of the heating cooking appliance that are capable of reducing the size of the cooking appliance while obtaining high combustion efficiency and reduced airflow resistance.

A heating cooking appliance is an apparatus that heats and cooks food. The present disclosure particularly addresses a gas cook top that generates heat through gas combustion to heat and cook food. This cook top, which employs a hot plate (also referred to as a 'hob'), is being used increasingly.

A cook top that operates through gas combustion includes a burner system. The burner system is a device that mixes gas with air for combustion. The burner system discharges gas fuel through a predetermined pipe, uses the air pressure being reduced around the discharged gas fuel, and mixes the gas with air in a burner pot. Then the air-gas mixture that enters the burner pot is mixed uniformly within the burner pot, the uniform mixture is combusted, and heat generated by the combustion is transferred to food through radiation and conduction, whereupon the food is heated and cooked.

In a heating cooking appliance according to the related art, in order to uniformly discharge the air-gas mixture after it enters the inside of the burner, the gas is introduced upward from the bottom of the burner. Thus, there is the limitation of the burner height increasing.

To improve on the limitation of the height of the burner increasing, a method of discharging the gas mixture from the side into the burner pot has been introduced. However, in order to reduce the height of the burner in this side discharging method, the port for discharging the gas mixture into the burner pot has simply been relocated to the side. Here, the gas and air mixing structure is in the form of a network of vertical fins spread across and rising from the horizontal floor of the burner pot, requiring a predetermined height for the burner pot. These passages and discharge nozzles are arranged to uniformly mix the gas-air mixture within the burner pot, and are essential structural components for allowing the gas discharged from the gas pipe to combust within the narrow confines of the burner pot.

When a burner pot is not beyond a certain size, the amount of gas and air that is able to flow inside would be insufficient, so that complete combustion of the gas within the burner pot could not occur. Moreover, when the burner pot is not at least a certain size, the amount of the gas-air mixture's airflow resistance would prevent sufficient turbulence, so that the gas-air mixture cannot be supplied uniformly.

Of course, by making the size of the burner pots the same and reducing the amount of gas entering a burner pot, gas combustion efficiency can be increased; however, the downside is a reduction in the amount of heat that can be generated.

SUMMARY

Embodiments provide a heating cooking appliance and a burner system of a heating cooking appliance that are capable of achieving complete combustion of gas for a high level of heat generated through increasing the quantity of introduced gas-air mixture (that is, the air-to-gas ratio, to raise gas combustion efficiency), and reducing air resistance for the gas-air mixture entering the burner pot so that the gas is uniformly mixed within the burner pot to combust evenly afterward.

Embodiments also provide a heating cooking appliance and a burner system of a heating cooking appliance that increase user product satisfaction by increasing installation convenience through furnishing a burner pot with a lower height to reduce the overall size, namely, the height of the heating cooking appliance, and reducing the overall component costs and shipping fees of the product.

In one aspect, a heating cooking appliance includes: a case; a plate covering a top of the case; a burner system within an interior defined by the plate and the case; and an exhaust unit disposed at a side edge of the case, wherein the burner system includes a burner pot providing at least a uniform mixing space for gas and air, a mixing tube unit at a side of the burner pot, and a nozzle unit maintaining a predetermined distance from the mixing tube unit, the mixing tube unit is provided with a plurality of mixing tubes, gas discharged from the nozzle and air are suctioned together into an inlet at one end of the mixing tube, an outlet at the other end of the mixing tube communicates with an opening in the burner pot, the opening communicates with the mixing space of the burner pot, and a mixture of the air suctioned together with the gas is discharged into the burner pot through the opening, and the plurality of mixing tubes provided in the same direction from one side of the burner pot.

In another aspect, a heating cooking appliance comprises:

A heating cooking appliance comprising: a case; a plate covering a top of the case; a burner system within an interior defined by the plate and the case; and an exhaust unit disposed at a side edge of the plate, wherein the burner system includes: a burner pot providing at least a mixing space for gas and air; a mixing tube unit at a side of the burner pot; and a nozzle unit maintaining a predetermined distance from the mixing tube unit, wherein the mixing tube unit is provided with a mixing tube, gas discharged from the nozzle unit and air are suctioned together into an inlet at one end of the mixing tube, an outlet at the other end of the mixing tube communicates with an opening in the burner pot, the opening communicates with the mixing space of the burner pot, and a mixture of the air suctioned together with the gas is discharged into the burner pot, and a discharge port of the opening has a height in a range of 1 to 0.8 times a height of the mixing space.

In a further aspect, a burner system comprises: a burner pot providing at least a mixing space therein for at least gas and air; a mixing tube unit installed to supply a gas mixture into the mixing space without leakage of the gas mixture; and a nozzle unit a predetermined distance apart from the mixing tube unit, the nozzle unit supplying gas to the mixing tube unit, wherein the mixing tube unit includes a plurality of mixing tubes that extend in one direction from a side portion of the burner pot.

In a still further aspect, a heating cooking appliance comprising: a case; a plate covering a top surface of the case, a burner system in an internal space of the plate and the case, and a discharge part on one side of the plate, wherein the burner system includes a burner pot providing a mixing space for uniformly mixing at least gas with air, a glow plate on a top of the burner pot, a mixing pipe unit leading gas and air to an inside of the burner pot, and a nozzle unit spaced a predetermined distance apart from the mixing pipe unit, the burner pot having an internal height of 18 to 30 mm.

In a yet further aspect, a burner system comprises: a plurality of nozzles injecting gas; a plurality of mixing tubes mixing gas with air injected from the nozzles; a burner pot having a circular shape and providing a mixing space for uniformly mixing gas with air injected from the mixing tube; and a swirler inside the burner pot, the swirler facilitating a mixture of gas with air even if a gas injecting speed changes.

The burner system according to the present disclosure allows for an overall reduction in size—especially in height—of the heating cooking appliance, while retaining the same level of heat generation as in related art heating cooking appliances. These effects from the present disclosure can be realized by compacting the burner system while increasing the combustion efficiency, and reducing air resistance.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

First Embodiment

Figure 1:
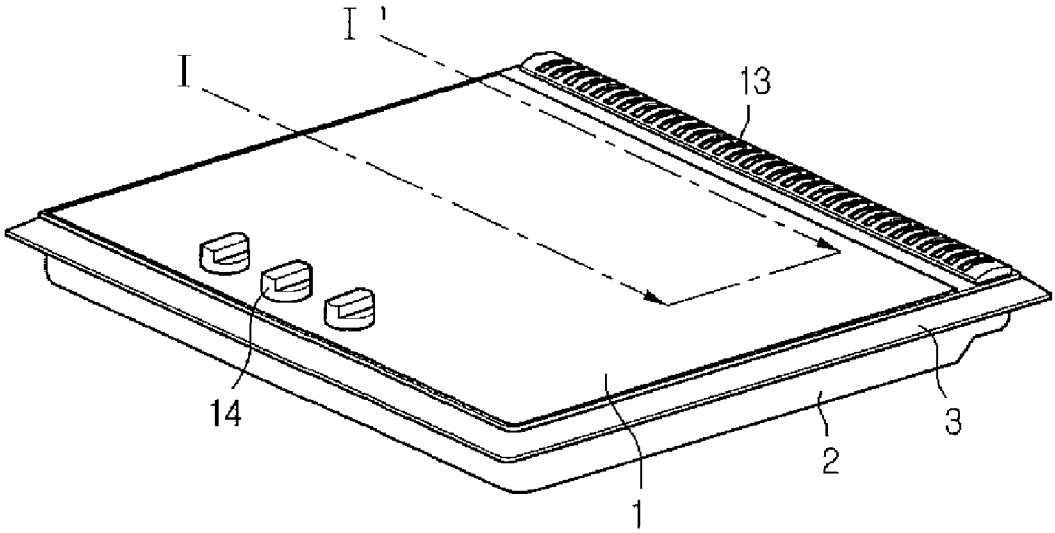
FIG. 1 is a perspective view of a heating cooking appliance according to the present disclosure.
Figure 2:
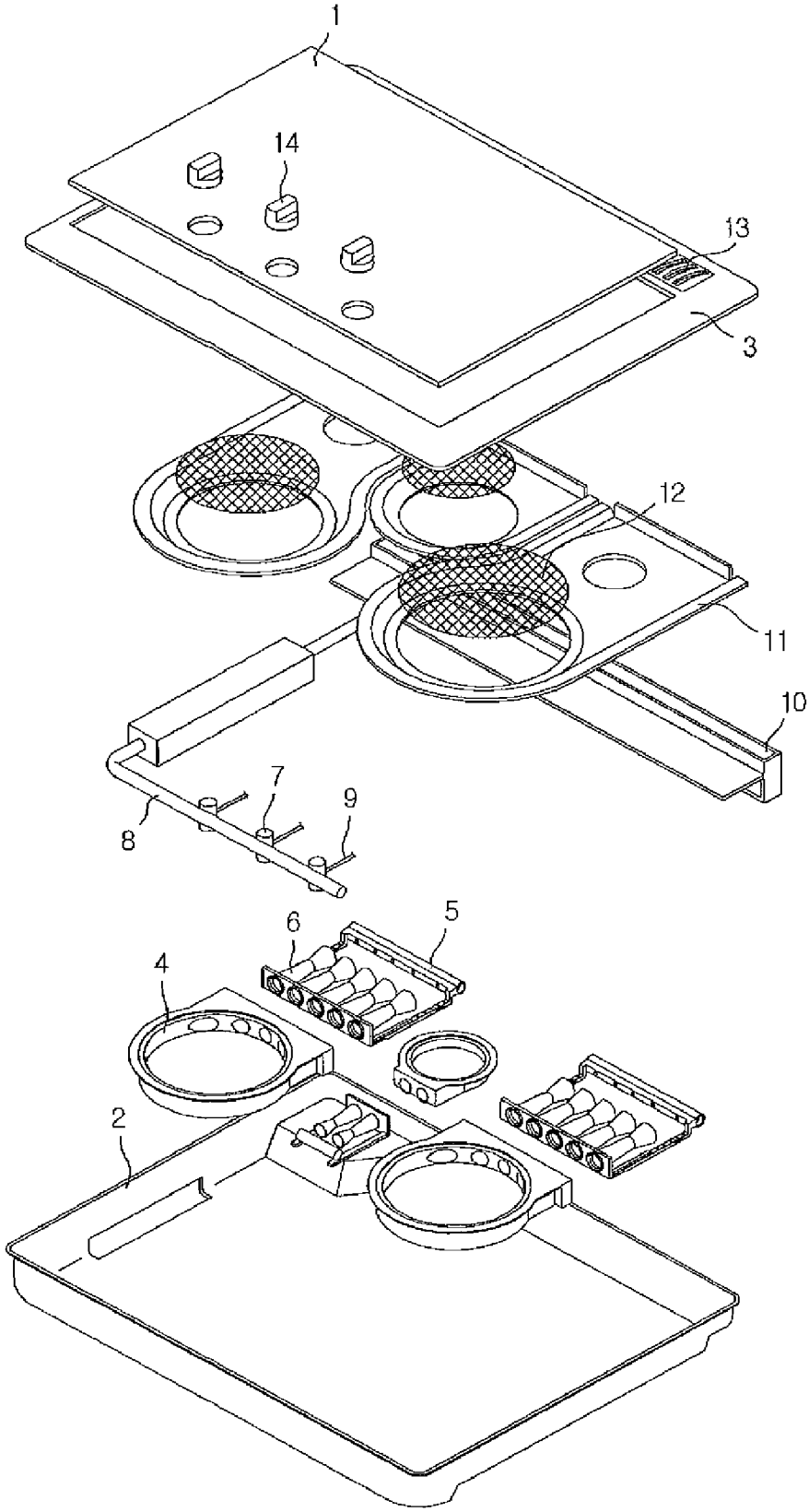
FIG. 2 is an exploded perspective view of a heating cooking appliance according to the present disclosure.

FIG. 1 is a perspective view of a heating cooking appliance according to the present disclosure, and FIG. 2 is an exploded perspective view of a heating cooking appliance according to the present disclosure.

Referring to FIGS. 1 and 2, a heating cooking appliance according to the present disclosure includes a case 2 that protects the lower portion of the main body to form the outer appearance of the lower portion of the appliance and having an open upper side, a ceramic plate 1 mounted on the upper side of the case 2, and a top frame 3 covering the peripheral portion of the ceramic plate 1. Also, added external features of the heating cooking appliance include an exhaust grill 13 formed at the rear portion of the cooking appliance for exhausting combusted gas, and a switch 14 formed at the approximate frontal portion of the ceramic plate 1 for on/off controlling of gas combustion. While the location and shape of the exhaust grill 13 and the switch 14 be varied in configuration and type, an exhaust for exhausting combusted gas and a switch for performing the on/off controlling of combusting gas are, of course, required.

The internal space defined by the case 2 and the ceramic plate 1 holds a plurality of components for performing gas combustion and exhausting, and controlling of the cooking appliance. A configurative description of the inside will be given. Like reference numbers are assigned to like elements disposed in plurality and/or symmetrically in the description below, and the elements shown in the diagrams represents the actual number of the elements.

First, three burner pots 4 are provided to sufficiently mix gas with air to allow uniform combustion afterward. A mixing tube unit 6 is disposed on the side surface of each burner pot 4 to supply a gas mixture through the side surface of the burner pot 4. Also, a nozzle unit 5 is disposed at a uniform distance from the mixing tube unit 6, and discharges gas toward the inlets of the mixing tube unit 6.

The burner frame 11 is disposed on top of the burner pots 4. The burner frame 11 supports the positions of the burner pots 4 and provides an exhaust flow of spent gas combusted on a glow plate 12.

An exhaust unit 10 for externally exhausting spent gas is disposed at the rear of the burner frame 11, and the exhaust grill 13 is disposed above the exhaust unit 10.

The glow plate 12 is disposed on the open upper side of the burner pot 4, and the glow plate 12 is heated at high temperatures generated by the combusting of the air-gas mixture. When the glow plate 12 is heated, radiant energy in a frequency range corresponding to the physical properties of the glow plate 12 is emitted. The radiant energy of the glow plate 12 includes at least visible light and preferably red light frequencies, so that a user can perceive, by means of the visible light, that the heating cooking appliance according to the present disclosure is operating. Of course, the glow plate 12 also functions to heat food, and to heat the ceramic plate 1 that also heats food.

A description of the structure for supplying gas to the nozzle unit 5 will be given.

Gas from the outside is supplied through a main gas supplying pipe 8 to the cooking appliance, and the supply of gas to each burner system is mediated through a gas valve 7 (which is controlled by the switch 14. After passing through the gas valve 7, the gas passes through a respective branch gas supplying pipe 9 to each of the nozzle units 5.

Figure 3:
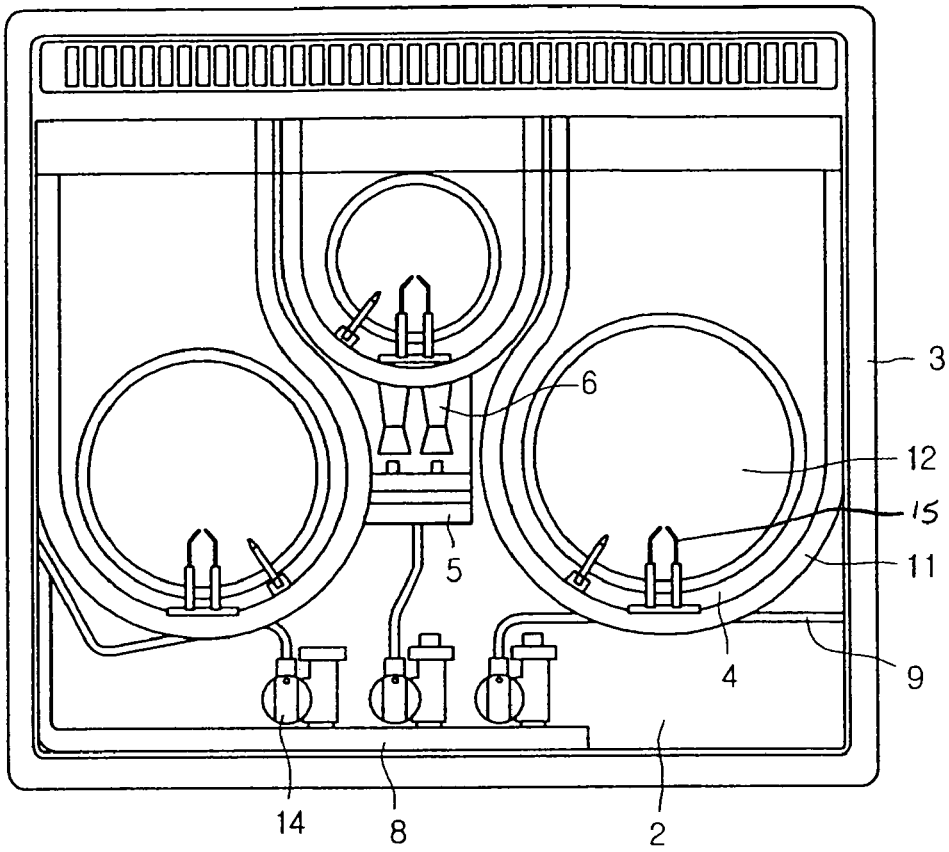
FIG. 3 is a plan view of a heating cooking appliance according to the present disclosure.

FIG. 3 is a plan view of a heating cooking appliance with the ceramic plate removed.

Referring to FIG. 3, there are two comparatively large burner pots 4 disposed at each side of the case 2, and a smaller burner pot 41 provided between the two larger burner pots 4. Thus, food vessels of corresponding heating sizes are placed over the respective burner pots 4 to heat food within the vessels.

The smaller-sized burner pot 4 in the center of the case 2 is supplied with gas-air mixture from front to rear, and the mixture of air and gas is completely mixed in a second stage within the burner pot. After the gas mixture is combusted on the glow plate 12, the spent gas is exhausted through the exhaust unit at the rear. On the other hand, the two comparatively larger burner pots 4 on either side of the case 2 are supplied with gas and air from rear to front, and the gas mixture is mixed in a second stage within the burner pot, after which the mixture is combusted on the glow plate 12 and then exhausted toward the rear of the burner pot.

The above arrangement of the burner pots 4 is intended to optimally configure a heating burner system.

Also, FIG. 3 provides easy visual access to the internal arrangement of each component in the heating cooking appliance.

The burner system of the heating cooking appliance according to the present disclosure has a lower burner height while increasing the quantity of air with respect to gas (hereinafter referred to as 'air ratio'), and provides a structure capable of reducing the flow resistance to the mixture of gas and air. Below, a detailed description will be provided on the structure of a burner system for a heating cooking appliance that achieves the main objects of the present disclosure.

Figure 4:
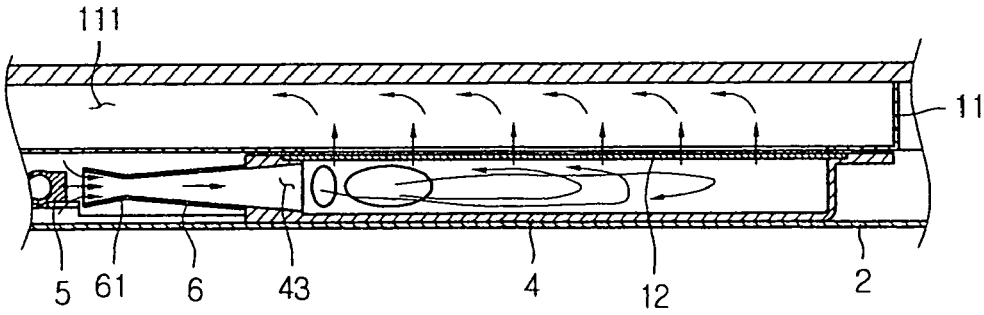
FIG. 4 is a sectional view of the burner system in FIG. 1 taken along line I-I'.

FIG. 4 is a sectional view of the burner system in FIG. 1 taken along line I-I'.

Referring to FIG. 4, a burner pot 4 is provided at the top of the case 2. The mixing tube unit 6 is disposed on the side surface of the burner pot 4. The burner pot has a coupling part provided with a vertical side to which the mixing tube unit is attached. The nozzle unit 5 is disposed at a predetermined distance from the mixing tube unit 6 to be proximate to the inlets of the mixing tube unit 6.

Here, the mixing tube unit 6 is aligned with the openings 42 of the burner pot 4. Also, because the mixing tubes 61 and the openings 42 provided on the mixing tube unit 6 are mutually provided in plurality to respectively align, the amount of air that enters along with the gas is maximized. The alignment of the mixing tube unit 6 and the openings 42 will be described below.

The height of the openings 42 is substantially equal to or formed slightly lower than the height of the burner pot 4. Specifically, the openings 42 are circular when viewed from the direction extending from the mixing tube unit 6 to the mixing tube 61. Furthermore, the diameter of the openings 42 is substantially equal to the height of the space within the burner pot 4 in which the gas and the air are able to mix sufficiently, thus enabling a maximum amount of gas-air mixture to diffuse within the burner pot. For this end, given the inner height of the burner pot 4 is 1, the height of the openings 42 is made to be within a range of 0.8-1 times the height of the burner pot 4. Therefore, because the inner heights of the openings 42 and the burner pot 4 are made substantially equal, the diffusion of the gas mixture within the burner pot 4 can be increased, and the height of the burner pot 4 can be minimized.

The mixing tube 61, when starting at the end of its inlet, initially provides a nozzle shape that gradually narrows in diameter, and then adopts the shape of a diffuser from the diametrically narrowest point to expand conically outward. The continuance between the diffuser portion of the mixing tube 61 and the diametrically increasing section of the opening 42 may be employed to reduce airflow resistance. That is, the diffusion angle of the air and the mixing tube 61 may be the same.

A description on the effects of the burner system will be given.

The gas discharged from the nozzle unit 5 enters the mixing tube unit 6 at high speed. Here, because the gas passes at high speed through the inlet of the mixing tube unit 6, the neighboring region of the opening of the mixing tube unit 6, according to Bernoulli's Theorem, becomes low in pressure. Therefore, outside air also enters the mixing tube 61, and the vapor that passes through the mixing tube 61 becomes a mixture of gas and air. The gas mixture that passes through the mixing tube unit 6 passes through the openings 42 and enters the interior of the burner pot 4, after which it is mixed a second time to combust on the glow plate 12. Also, the combustion heat from the gas mixture heats the glow plate 12 to make the glow plate 12 glow red and generate radiant heat.

Here, a large number of tiny holes are formed in the glow plate 12, through which the gas mixture passes and combusts, and spent gas is exhausted through an exhaust passage 111 and guided to the exhaust unit 10. The exhaust passage 111 is the space defined between the bottom of the ceramic plate 1 and the top of the burner frame 11.

Figure 5:
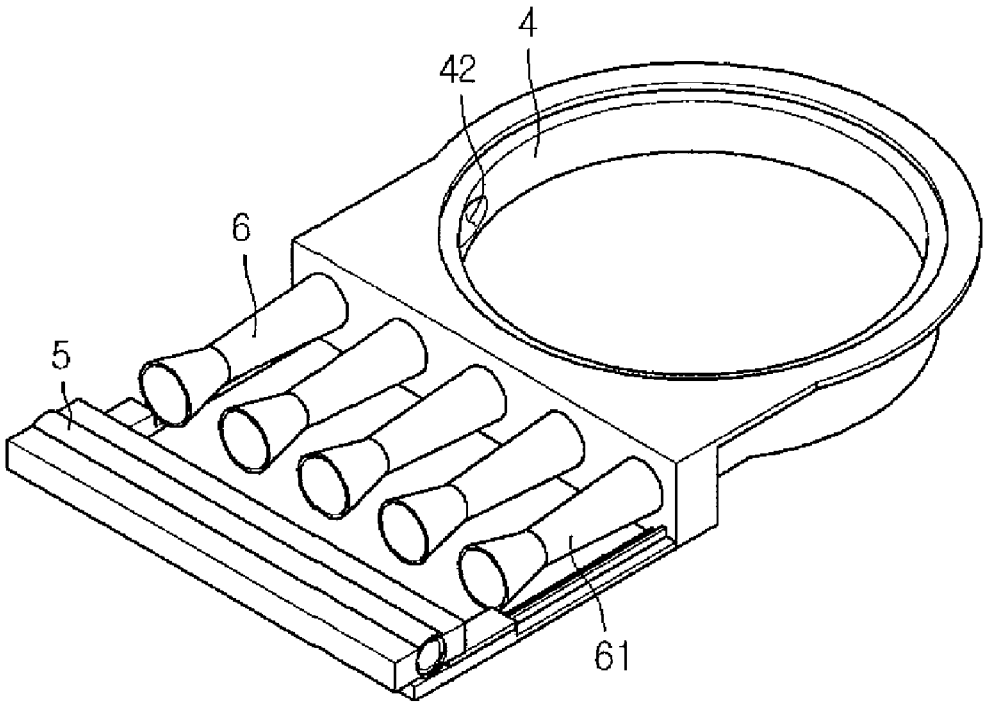
FIG. 5 is a perspective view of a burner system according to the present disclosure.

FIG. 5 is a perspective view of a burner system according to the present disclosure.

Referring to FIG. 5, as already described, the mixing tube unit 6 is coupled to one side of the burner pot 4. A plurality of mixing tubes 61 is provide on the mixing tube unit 6, and a plurality of openings 42 aligned with the mixing tubes 61 are formed in the burner pot 4. Also, a nozzle unit 5 is disposed a predetermined distance from the inlet of the mixing tube unit 6.

The nozzle unit 5 is straightly formed because the plurality of inlets formed on the mixing tube unit 6 is arranged in a straight line, unlike the circular burner pot 4. Therefore, the arrangement of the burner system may become more compact.

Thus, because a plurality of mixing tubes 61 are provided horizontally in alignment with the mixing tube unit, the amount of air that enters along with the gas discharged from the nozzle unit 5, or the air ratio, can be increased. In other words, by installing a plurality of mixing tubes 61, a large amount of air is suctioned into each mixing tube 61 along with the gas. The difference between the above suctioning of a large volume of air, versus suctioning gas through a single mixing tube 61 becomes readily apparent. For example, in the case where gas is suctioned through a single mixing tube, only the atmosphere around the single mixing tube is of low pressure so the air in that vicinity is suctioned; however, when gas is suctioned through a plurality of mixing tubes, the total volume from which air enters increases, so that the combined amount of air suctioned through all of the mixing tubes is greater.

The mixing tubes 61 of the mixing tube unit 6 are provided at the same height in alignment. Of course, the centers of alignment may be slightly offset, but they remain substantially aligned. As such, by providing aligned mixing tubes 61, the gas mixture entering the inside of the burner pot 4 collides together generating greater vortices, further mixing the air and gas and therefore, raising the combustion efficiency of the gas. A limit to height discrepancies of the mixing tubes 61 is imposed because the height at which the mixing tubes 61 can be disposed is restricted by how the openings may be formed.

The directions in which the mixing tubes 61 extend may be the same direction. That is, the lines of extension for the mixing tubes 61 may not intersect one another. Therefore, as described above, the gas mixture that enters the burner pot 4 from different mixing tubes is able to promote the creation of vortices, so that the manufacturing process of the mixing tube unit 6 is simplified, and the manufacturing process of the nozzle unit 5 aligned with the mixing tube unit 6 can also be made simpler and easier.

Figure 6:
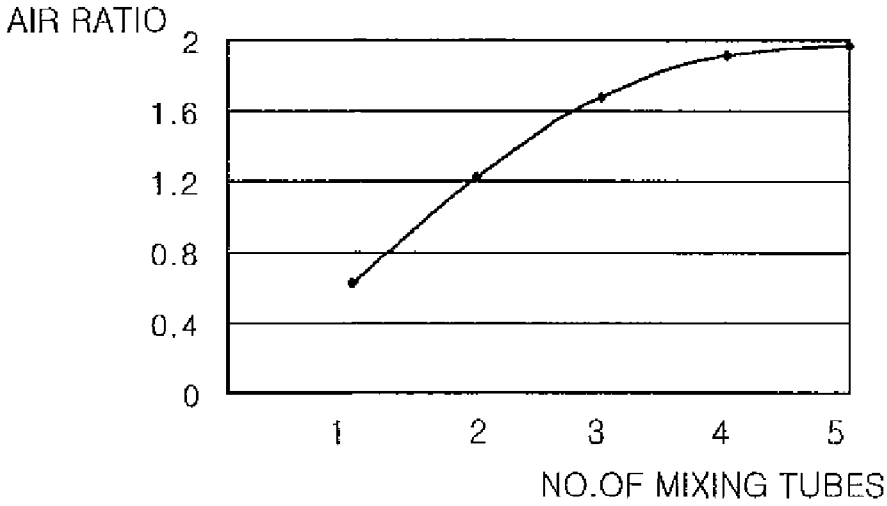
FIG. 6 is a graph showing changes in air mixture ratios according to the number of mixing tubes.

In addition, the number of mixing tubes provided on the mixing tube unit 6 is five, as shown in the diagrams. This is a result of multiple tests that produced the changes in air ratios according to the number of mixing tubes, as depicted in FIG. 6. Here, only the number of mixing tubes was altered while other conditions were kept the same.

Referring to FIG. 6, when the number of mixing tubes was increased from one to five, the increase in the air ratio was drastic at first, and gradually decreased when the number exceeded five tubes. Since the effect on the air ratio from adding an additional mixing tube is nominal when considering the added cost involved, the number of mixing tubes was set at five.

Under the above circumstances, the mixing tube configuration may be one where the mixing tubes are aligned and evenly divided across the diameter of the burner pot, and the outermost mixing tubes are substantially disposed at the ends of the burner pot diameter, in order to improve the mixing efficiency of the gas mixture entering the burner pot. This is because the formation of vortices within the burner pot is facilitated.

Figure 7:
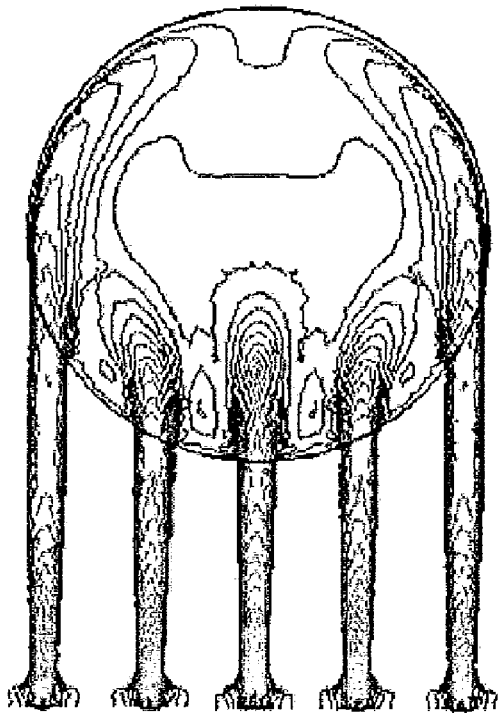
FIG. 7 is a view showing a constant velocity profile within a burner pot of a burner system according to the present disclosure.
Figure 8:
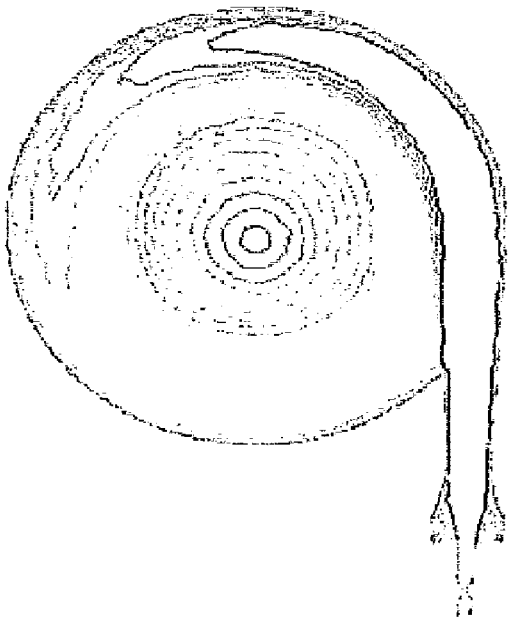
FIG. 8, in contrast to FIG. 7, is a view showing a constant velocity profile within a burner pot with a single mixing tube tangential thereto.

FIGS. 7 and 8 are respectively a view showing a constant velocity profile within a burner pot of a burner system according to the present disclosure, and a view showing a constant velocity profile within a burner pot with a single mixing tube tangential thereto.

To compare FIGS. 7 and 8, FIG. 7 shows the gas mixture within the burner pot 4 at a constant velocity overall, without a velocity gradient In contrast, FIG. 8 shows the gas mixture moving in a circular motion to form a dense constant velocity profile, so that the velocity at the center of the burner pot 4 decreases and the gas mixture is unevenly distributed, causing regions of uneven combustion when the gas mixture passes through the glow plate.

When referring to these test results, the flow of the gas mixture moves tangentially to the burner pot and then flows in different directions, creating visible colliding lines. Because colliding regions are generated, a large vortex is generated to cause the gas mixture within the burner pot to diffuse overall and the gas and air to mix evenly within the entire burner pot. Thus, by uniformly mixing the gas and air within the burner pot, even when the height of the burner pot is lowered, a uniform mixture of gas can be obtained for a uniform combustion.

From another perspective, the colliding regions and vortex generated within the burner pot 4 reduce the gas mixture flow velocity. Thus, the gas mixture receives adequate convective force from heated air as it combusts on the glow plate 12. Accordingly, the gas mixture within the burner pot 4 rises quickly and passes through the glow plate to be combusted, after which it is exhausted to the outside. In this way, the gas mixture discharged from the mixing tubes 61 can be uniformly discharged into the burner pot 4, so that a decrease in the flow resistance to the gas discharged from the mixing tubes 61 can be realized.

Second Embodiment

Figure 9:
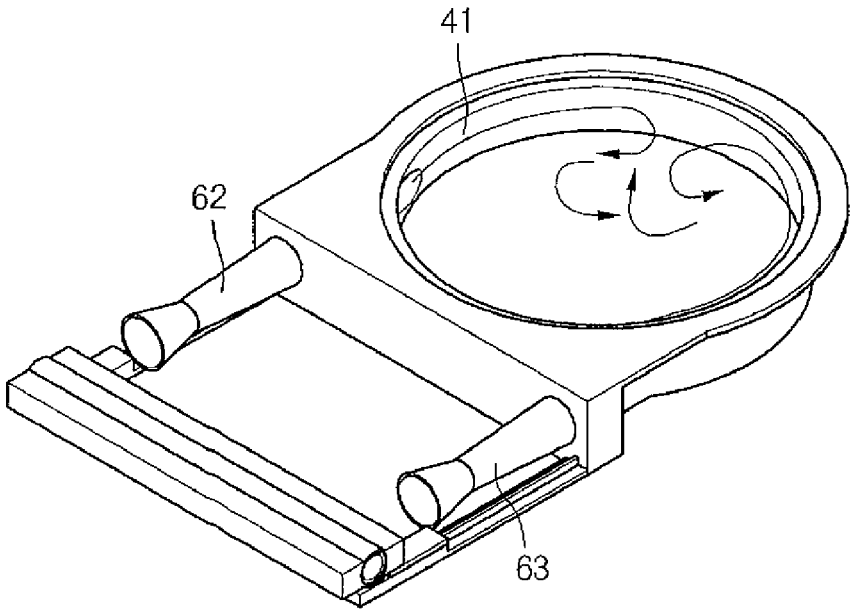
FIGS. 9, 10, and 11 are perspective views of burner systems according to other embodiments of the present disclosure.
Figure 10:
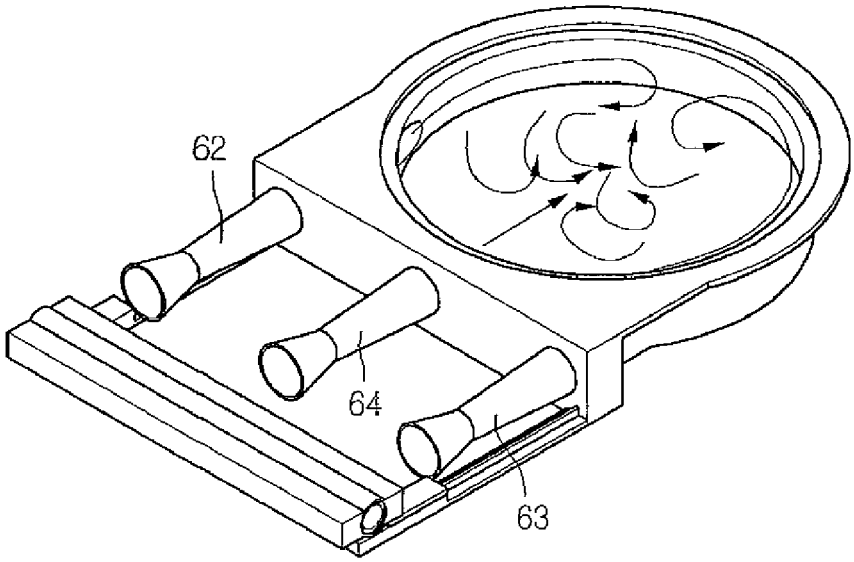

FIGS. 9 and 10 are perspective views of burner systems according to the embodiment of the present disclosure.

Referring to FIG. 9, descriptions of the second embodiment that are the same will not be given, and only descriptions on characteristically different elements will be furnished, According to the second embodiment, mixing tubes provided on the mixing tube unit 6 consist of a first mixing tube 62 and a second mixing tube 63 at the end of the mixing tube unit 6. Even when two mixing tubes are thus provided, the flow of the gas mixture discharged from the pair of mixing tubes 62 and 63 is discharged in different directions, creating two different routes flowing along the inner surface of the burner pot 4. Thus, a collision region due to two-way circulation inside the burner pot 4 is formed, so that the gas mixture is uniformly distributed and mixed within the burner pot 4, and a uniform gas mixture is evenly distributed within the entire burner pot 4. In this way, the uniform gas mixture is generated, and when the gas mixture is combusted on the glow plate 12, the gas is evenly combusted over the entire region of the glow plate 12.

The arrows in FIG. 9 indicate the airflow of the gas mixture.

Referring to FIG. 10, while other portions are the same as in FIG. 9, a further mixing tube 64 is additionally provided in the middle of the mixing tube unit 6. The third mixing tube 64 supplies gas mixture to the burner pot 4 to compensate for any non-uniformity in the gas mixture discharged through the first and second mixing tubes 62 and 63.

FIGS. 9 and 10 show that the number of mixing tubes provided to the mixing tube unit 6 may be different. However, as shown in FIG. 6 and its related description, if an equal amount of gas is supplied, a five-mixing pipe configuration produces an optimum amount of radiant heat. While the embodiment in FIGS. 9 and 10 are different, because the gas mixture flows along the inner surface of the burner pot creates a colliding region, a uniform combustion can be obtained to a certain degree within the burner pot.

Third Embodiment

Figure 11:
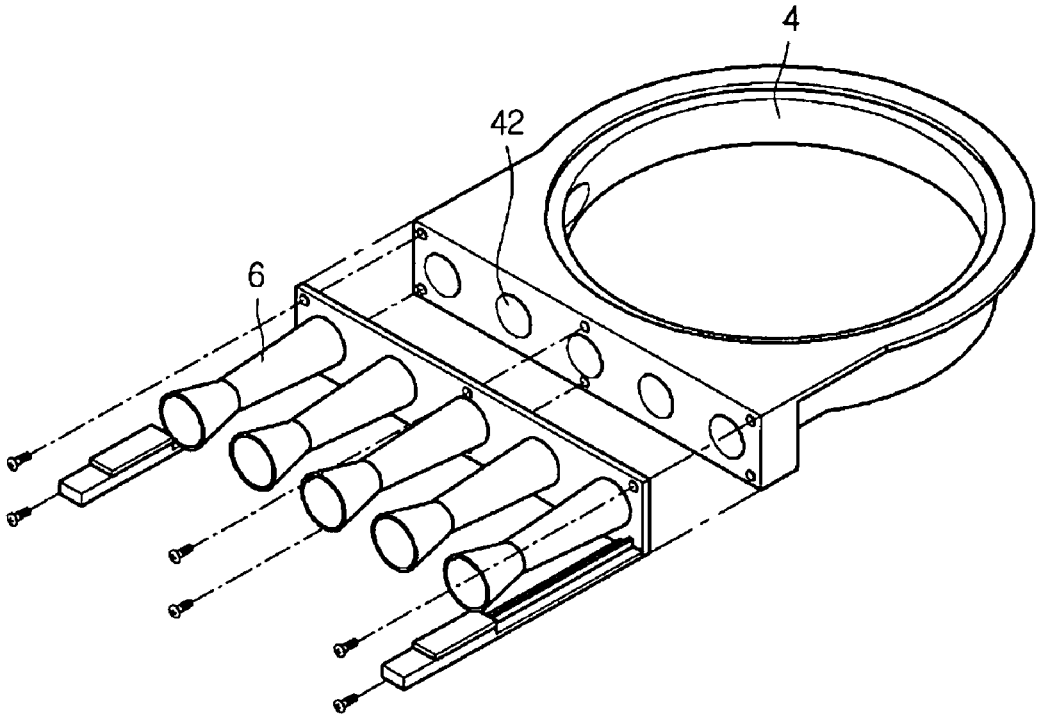

FIG. 11 is a perspective view of a burner system according to the third embodiment of the present disclosure.

Referring to FIG. 11, the burner system according to the present disclosure includes a burner pot 4 provided with a round recessed portion for thoroughly mixing air and gas suctioned through the mixing tube unit 6, and the mixing tube unit 6 coupled at one side of the burner pot 4. Five mixing tubes are provided on the mixing tube unit 6. Thus, because the mixing tube unit 6 is integrally formed, when it is fastened once to the burner pot 4, the five mixing tubes are aligned simultaneously. Therefore, there is little possibility that the mixing tubes 61 become misaligned with the openings 42, the mixing tubes 61 become misaligned with the nozzle unit 5, and the distances between the respective inlets of the mixing tubes 61 and the nozzle unit 5 become different so that the amount of gas and air entering the respective mixing tubes become different. Compared to visually aligning each of the plurality of mixing tubes fastened to the nozzle unit 5 on the respective openings, the above embodiment is more precise.

The effects of the above integrally formed mixing tube unit 6 is that even when there is a slight offset between the centers of the discharge holes on the nozzle unit for discharging gas and the inlets of the mixing tubes, there is substantially less possibility of a reduced low pressure region brought about by a larger offset of a discharge hole from the centers of a mixing tube inlet, which causes a drastic reduction of efficiency in air entering the inlet.

By thus fastening the mixing tube unit 6 to the burner pot, manufacturing and assembling efficiency can be achieved, the seal between the mixing tube unit 6 and the burner pot can be improved, and the rate of defects and manufacturing cost can be lowered.

The above method of fastening each mixing tube 61 to the mixing tube unit 6 may employ the method of fastening the plurality of mixing tubes 61 to the mixing tube unit 6 while supported on a predetermined jig, or alternately, providing the plurality of mixing tubes 61 on the mixing tube unit 6 from the start.

Because the inlets of the plurality of mixing tubes 61 can be aligned when fastening the mixing tubes 61 to the mixing tube unit 6 using a predetermined jig, the distances between the nozzle unit 5 and the inlets of the plurality of mixing tubes 61 can be comparatively uniform.

Figure 12:
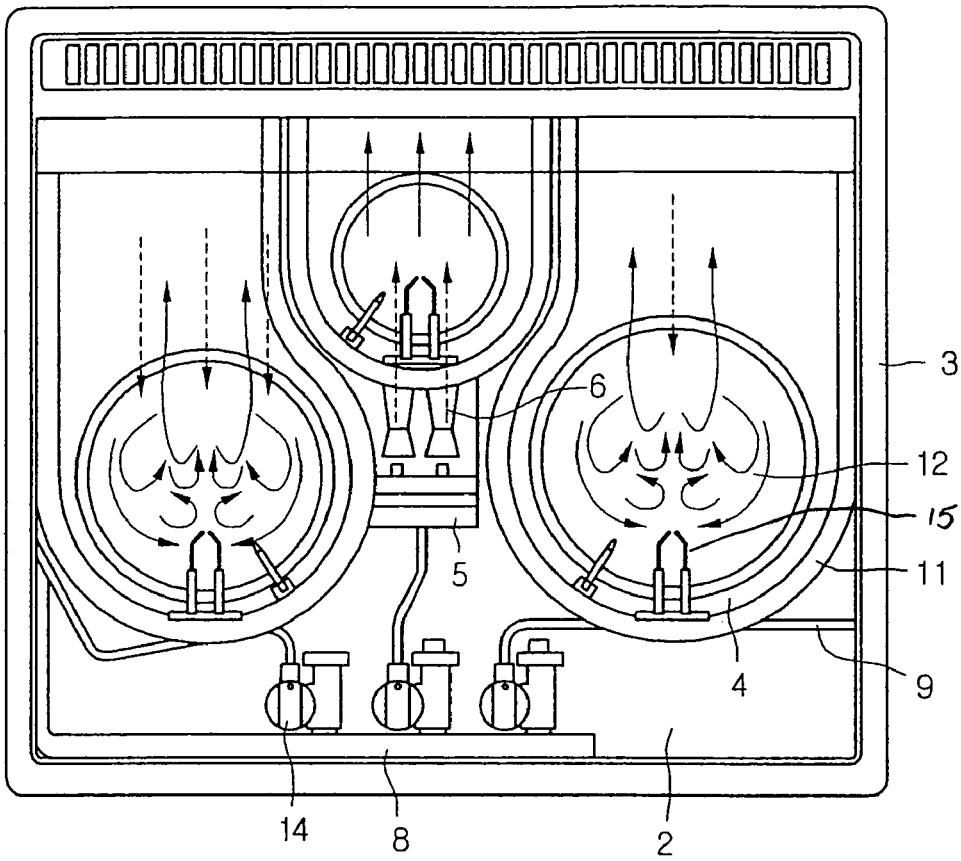
FIG. 12 is a plan view showing inlet and outlet paths for gas-air mixture through burner pots.

FIG. 12 is a plan view showing inlet and outlet paths for gas-air mixture through burner pots.

Referring to FIG. 12, in a burner system disposed on either side of a heating cooking appliance, after a gas mixture enters through the front, the gas mixture is mixed sufficiently in a first stage within the burner pot 4. Then, the gas mixture moves upward through the glow plate and combusts, after which the spent gas is exhausted toward the rear.

In this burner system according to the present disclosure, sufficient collision amongst the gas mixture occurs within the burner pot 4 to create sufficient turbulence. Therefore, the moving velocity components of the gas mixture that were originally moving forward are negated, and mixing of air and gas inside the entire burner pot occurs. Then, the gas combustion takes place as the gas mixture rises through the glow plate, where the combusting gas moves uniformly therethrough.

Therefore, in a burner system with burners on either side of a heating cooking appliance according to the present disclosure, despite the flow directions of in flowing and discharged gas being opposed with respect to the center of the burner system, gas is able to flow without any flow resistance.

The present disclosure is not limited to the above-described embodiments, and may also include the following embodiments.

First, a predetermined insulator may be further provided between the contacting surfaces of the case and the burner pot. This is either because the thermal insulation ability of the burner itself is ineffective or the thermal stability of the case is inadequate, so that if components with a weak thermal resistance are disposed below the case, the added insulator will protect them.

Also, the mixing tubes suction gas mixture in one direction with the burner pot in the middle, so that the gas mixture suctioned in mutually different directions is able to create vortices inside the burner pot and mix evenly due to the reduction in airflow resistance, and then combust as it is discharged through the glow plate 12. Here, there is no need to impose restrictions on the range of each suctioning direction of the mixing tubes to evenly distribute the gas mixture within the burner pot. In fact, the mixing tubes may be disposed at different angles and separated from one another. However, the uniform and even arrangement of the mixing tubes may present the most effective means for distributing the gas mixture evenly and generating turbulence within the burner pot.

Also, while not specifically illustrated, a swirler may be further added within the burner pot to augment turbulence generation of the gas mixture introduced into the burner pot. In this case, collision of gas mixture flow within the burner pot occurs, so that uniform combustion of the gas mixture may be promoted.

Additionally, the exhaust unit has been described as being disposed at the rear of the ceramic plate. While it is not limited thereto and may be disposed at any one edge of the ceramic plate, there is the possibility that in this case, a user may suffer a burn from expelled hot gas. When the heating cooking appliance is installed in a corner of a kitchen, the exhaust unit may be formed on a side of the heating cooking appliance without being potentially hazardous.

Furthermore, while the above descriptions have one mixing tube unit installed on one burner pot, two or more may be installed, in which case, the air ratio will increase and induce further turbulence generation. However, one mixing tube unit is sufficient for each burner pot, and the installation of two or more on each burner pot would not only increase manufacturing costs, but also increase the overall size of the heating cooking appliance.

According to the present disclosure, the combustion efficiency of gas in the burner system is improved, the flow resistance to the gas and air is reduced, and the air ratio with respect to the suctioned gas is increased. For example, from test results, the combustion performance of the burner system according to the present disclosure reduces emissions of carbon dioxide to 20 ppm (parts per million) while improving combustion efficiency. Moreover, the overall size (specifically in terms of height) of the heating cooking appliance, when compared overall to the related art, is smaller, thereby facilitating installation, reducing material costs, and becoming easier to use. Of course, these improvements over the related art are apparent with respect to related art heating cooking appliances with comparable thermal outputs.

Forth Embodiment

Figure 13:
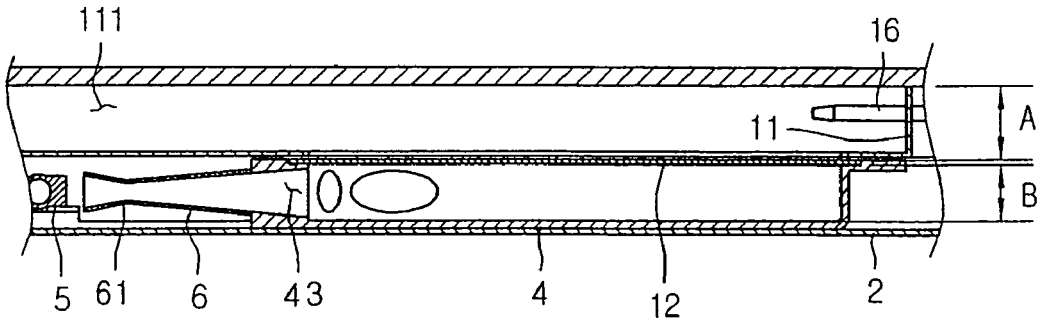
FIG. 13 is a sectional view of the burner system in FIG. 1 taken along line I-I' according to the forth embodiment of the present disclosure to provide the optimized height of the burner pot.

FIG. 13 is a sectional view of the burner system in FIG. 1 taken along line I-I' according to the forth embodiment of the present disclosure to provide the optimized height of the burner pot.

Referring to FIG. 13, the present disclosure provides the optimized height of the burner pot 4 and an overall height of the heating cooking appliance.

More specifically, among the overall height of the heating cooking appliance, the height A between the ceramic plate 1 and the glow plate 12 is within about 15 mm due to the ignition plug 15 and the thermostat 16. The height of the glow plate 12 and the thickness of the external case constituting the burner pot 4 cannot be reduced in order to maintain combustion efficiency and rigidity of the burner pot 4. As a result, to reduce the overall height of the heating cooking appliance, the internal height B of the burner pot 4 needs to be reduced. The internal height B of the burner pot 4 is a distance from the bottom inside the burner pot 4 to the bottom of the glow plate 12, and is a space where a mixture of air and gas is combusted in the burner pot 4 without interruption of external additional structures.

However, as the internal height B of the burner pot 4 decreases, an internal space for mixing air and gas is also decreased. Thus, there are limitations in uniformly mixing air with gas. Although there may be a method of increasing a horizontal sectional area of the burner pot 4, the size of the burner pot is limited by the overall size of the heating cooking appliance. Furthermore, since the horizontal width of the burner pot 4 has a margin where appropriate mixing is feasible when considering the speed of gas flowing into the side of the burner pot 4 it is not a feasible factor for improving the mixture of air and gas.

The inventor of the present disclosure performed a plurality of experiments for achieving the optimal internal height of the burner pot 4 under general various conditions, and achieved very special conclusions.

Figure 14:
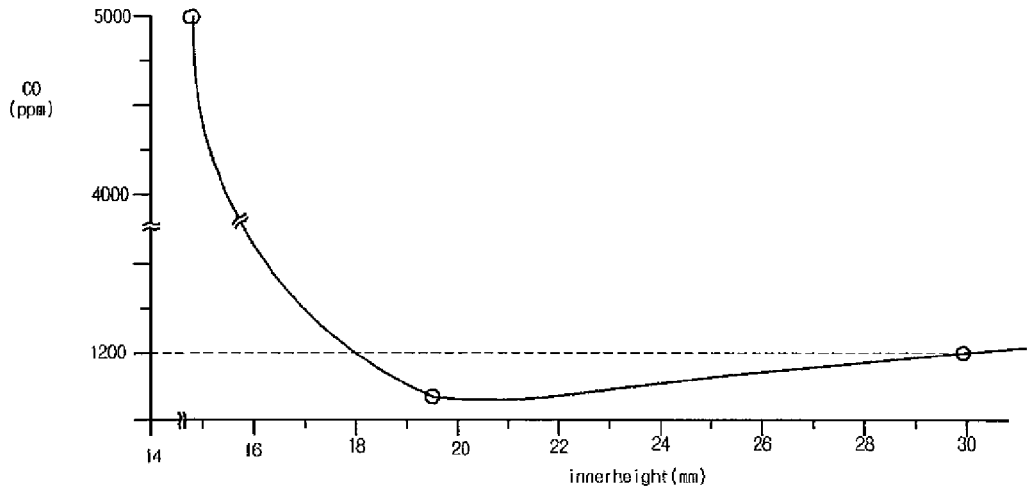
FIG. 14 is a graph of an experimental result.

FIG. 14 is a graph of an experimental result, comparing the internal height of a burner pot with an amount of generated carbon monoxide. The amount of generated carbon dioxide is an amount of incomplete combustion gas, which is generated when gas and air are not uniformly mixed. That is, because of the small internal space capacity of the burner pot 4, air and gas are not completely mixed for combustion. If this occurs, a user's safety may be in danger by carbon monoxide. Additionally, the incomplete combustion gas is generated in the glow plate, such that the overall area of the glow plate has uneven temperatures.

Referring to FIG. 14, an amount of carbon monoxide in the combustion gas is measured by changing the internal height B of the burner pot 4. According to the measured result, the amount of carbon monoxide drastically increases as the internal height B of the burner pot 4 decreases below 19.5 mm. There is no carbon monoxide decrease when the internal height B of the burner pot 4 is higher than 19.5 mm. On the contrary, the amount of carbon monoxide increases when the internal height B of the burner pot 4 is excessively high. This is caused by the mixed gas flowing from the side of the burner pot 4 condensing toward one direction in a broad space, or because the uniform mixture of air and gas, which is caused by a turbulence flow, does not occur due to the internal space increase of the burner pot 4. In the graph of FIG. 14, a gas injecting pressure is 200 mmAq and the number of the mixing tubes 6 and nozzles 5 is five, respectively. Additionally, the size of the opening is 0.8 to 1.0 times of the internal height of the overall mixing tube 6.

According to the above experimental result, the burner pot 4 has the internal height of 18.0 to 30.0 mm. This satisfies a management condition that limits an amount of carbon monoxide in a discharge gas below 1,200 ppm. That is, the internal height B of the burner pot 4 ranges between 18.0 and 30.0 mm, to meet a management condition that keeps a discharge amount of carbon monoxide below 1,200 ppm.

According to the above numerical values, the heating cooking appliance can be manufactured with the height of 40 to 60 mm. This numerical value for the height is considered to satisfy consumer's demands. Since gas and air are smoothly mixed in the burner pot 4 of the compact cooking heating appliance, uniform combustion performance can be achieved in the glow plate 12, and also since gas is combusted in an overall area of the glow plate 12, more increased cooking area can be achieved.

Fifth Embodiment

The fifth embodiment is identical to the forth embodiment except for a predetermined structure facilitating a mixture of gas and air in a burner pot. The description for the identical structure will be quoted from that of the forth embodiment, and only the description different from that of the forth embodiment will be made in detail below.

According to the structure of the forth embodiment, the combustion efficiency for a high-speed flowing gas is high, but the combustion efficiency for a low-speed flowing gas is low. Therefore, provided is an additional structure facilitating a mixture of gas and air.

For example, with the switch 14 set at a high speed, i.e., in a case where gas is injected with a pressure of 200 mmAq, carbon monoxide occurs like the forth embodiment. On the other hand, with the switch 14 set at a low speed, i.e., in a case where gas is injected with a pressure of 160 mmAq, carbon monoxide of 2000 to 3000 ppm occurs.

Figure 15:
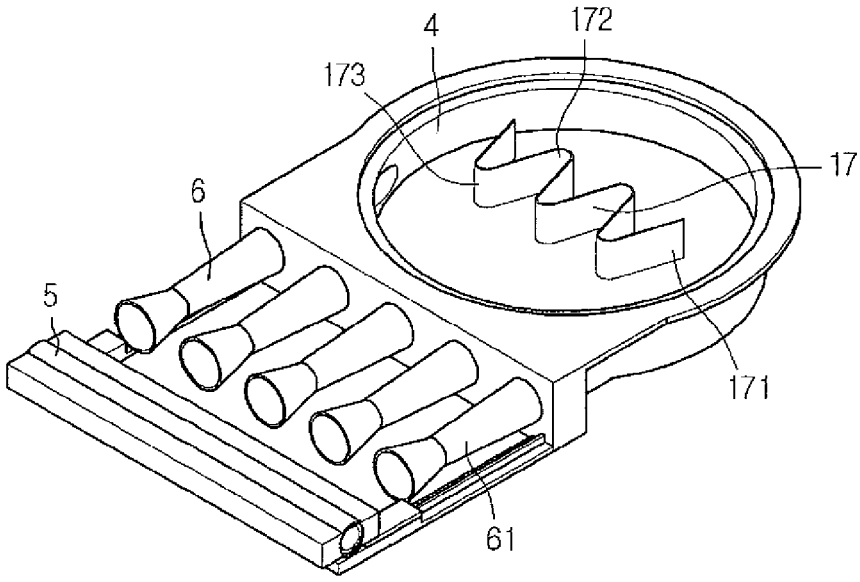
FIG. 15 is a perspective view of a burner system according to a fifth embodiment.

FIG. 15 is a perspective view of a burner system according to a fifth embodiment.

Referring to FIG. 15, a swirler 17 with a "W" shape is disposed in the burner pot 4 to smoothly mix gas with air. The swirler 17 is fixed at the internal bottom of the burner pot 4.

In more detail, when a place where the mixing tube 61 is disposed is called as the rear and its opposite place is called as the front, both end parts of the swirler 17 are slantly extended toward the front to form a flowing guide 171. The flowing guide 171 guides the mixed gas, which is discharged from the two mixing tubes 61 at the outermost positions toward the front of the swirler 17 for the mixture of gas and air. An exfoliation phenomenon of the mixed gas occurs at the end of the flowing guide 171, and a plurality of small swirls occur at the rear of the swirler 17, that is, a place opposite to where the mixed gas collides. It may be assumed that uniform mixture of gas and air improved due to the swirls.

A mixed gas injected from the mixing tubes 61 at the outmost positions swirls toward the front by the flowing guide 171 and a mixed gas injected from the remaining mixing tubes 61 generates swirls at the rear of the swirler 17.

In more detail, a starting point 173 of the flowing guide 171 is disposed on a line crossing over the center of one mixing tube 61, such that the mixed gas discharged from the mixing tube 61 is divided into the front space and the rear space of the swirler 17. Here, the starting point 173 of the flowing guide 171 is a turning point where a turn 172 starts in the flowing guide 171. The turning point is placed on a line crossing over the center of one mixing tube 61 adjacent to the mixing tubes 61 at the outmost positions, such that a mixture of air and gas discharged from the mixing tube 61 flows toward the front and rear of the swirler 17.

Through the above operations, it is apparent that uniform mixture of gas and air can be improved.

A plurality of turns 172, which are bent toward the front and rear directions, are formed on the middle of the swirler 17. Due to the turns 172, a plurality of small swirls are generated along the forming direction of the turns 172. As a result, the combustion efficiency of the mixed gas can be improved.

According to the fifth embodiment, although the gas is injected from the mixing tube 61 at low speed, due to the swirls in the burner pot 4, the uniform mixture of gas and air can be enhanced. Additionally, due to the fluid flowing path, uniform gas combustion and gas combustion improvement can be achieved over the entire region of the burner pot 4.

Figure 16:
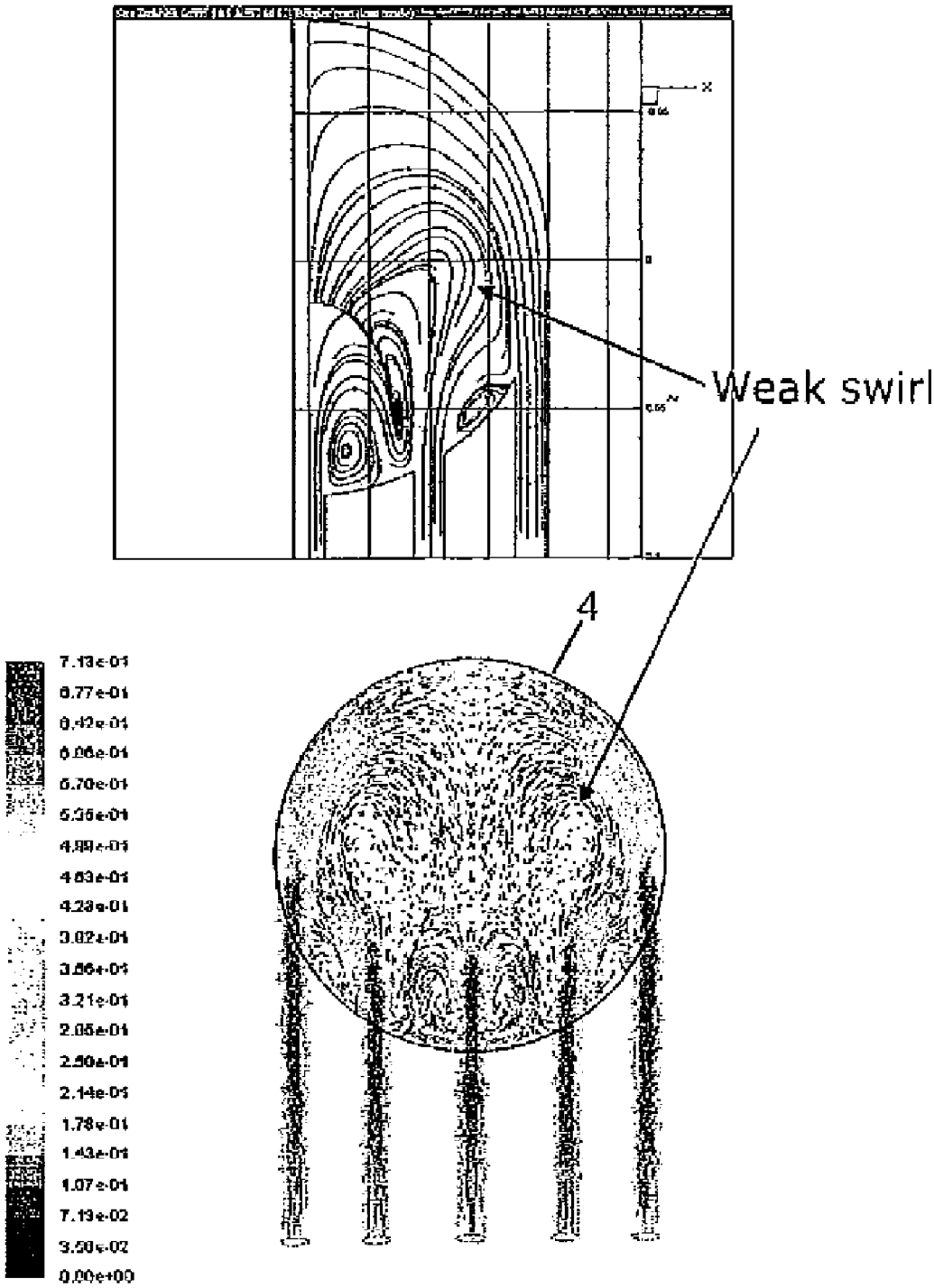
FIGS. 16 and 17 are computer graphic views of a mixed gas flow in a burner pot with and without swirler, respectively.
Figure 17:
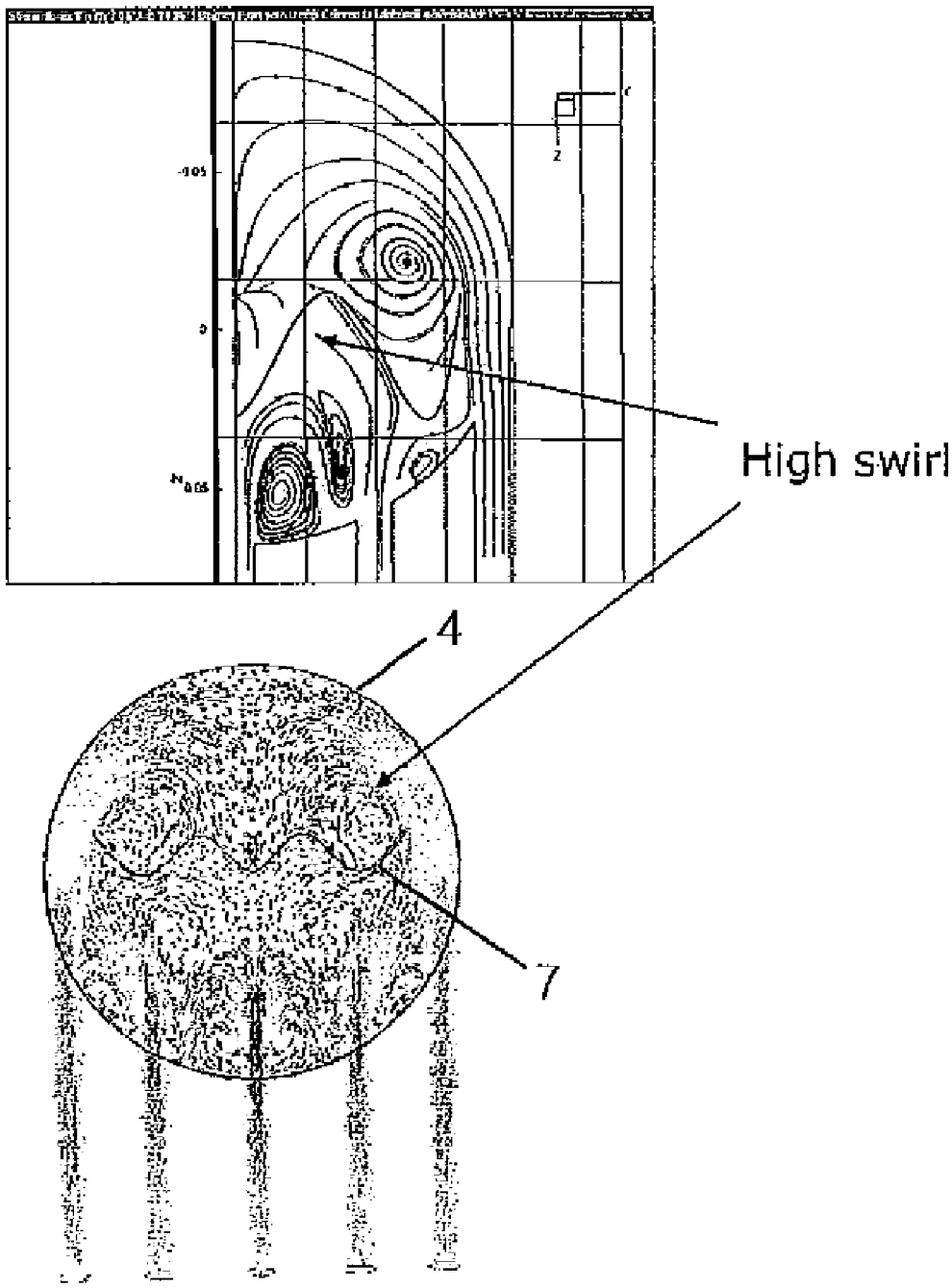

FIGS. 16 and 17 are computer graphic views of a mixed gas flow in a burner pot with and without swirler, respectively. Referring to FIGS. 16 and 17, swirls occur in the burner pot 4 by the "W"-shaped swirler 17. This facilitates the uniform mixture of gas and air.

Sixth Embodiment

The sixth embodiment is identical to the fifth embodiment except for a swirler with a different shape. Therefore, the description for the identical component will be omitted for convenience.

Figure 18:
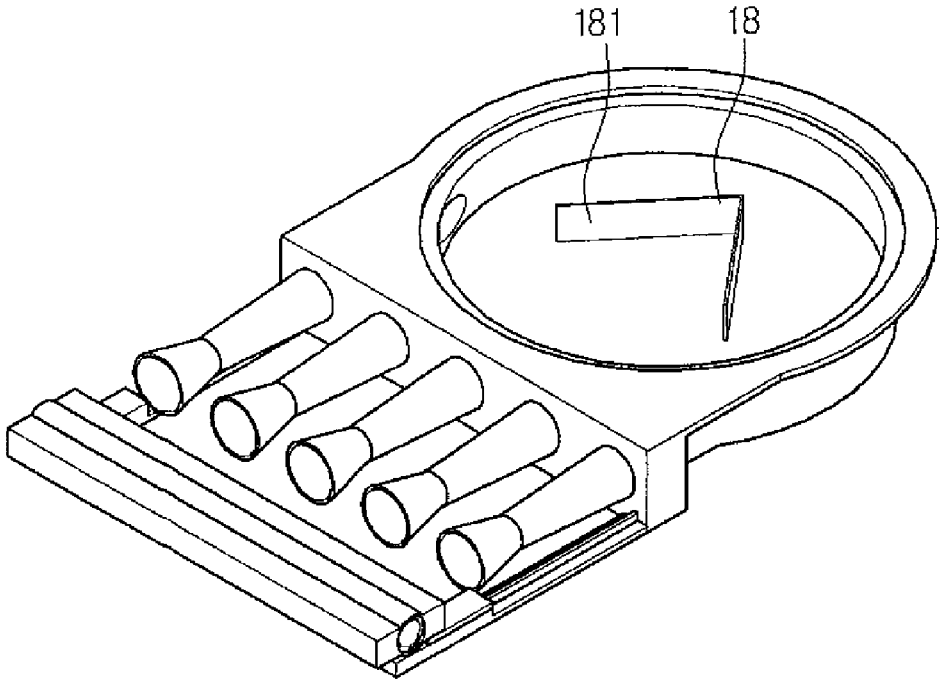
FIG. 18 is a perspective view of a burner system according to a sixth embodiment.

FIG. 18 is a perspective view of a burner system according to a sixth embodiment.

Referring to FIG. 18, provided is a swirler 18 having two flowing guides 181 in the burner system. The two flowing guides 181 extend toward the rear and converge into one point at the front. That is, the swirler 18 has a "V"-shape.

A plurality of small swirls occur at the rear of the two flowing guides 181, that is, a place where the mixed gas collides when they are injected from the three mixing tubes 61 at the middle of the heating cooking appliance. The mixed gas injected from the mixing tubes at the both ends passes through the side of the flowing guide 181, and is mutually mixed at the front of the flowing guide 181, that is, a side opposite to where the mixed gas collides.

Since a plurality of swirls are generated by the swirler 18, combustion efficiency of the mixed gas can be improved.

Seventh Embodiment

The seventh embodiment is identical to the fifth embodiment except for a swirler with a different shape. Therefore, the description for the identical component will be omitted for convenience.

Figure 19:
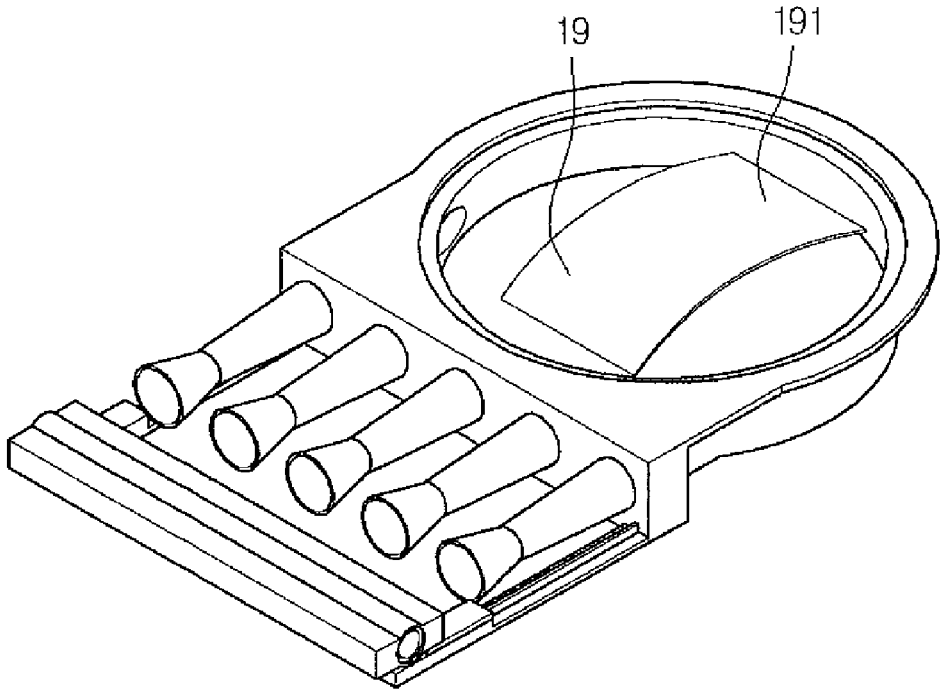
FIG. 19 is a perspective view of a burner system according to a seventh embodiment.

FIG. 19 is a perspective view of a burner system according to a seventh embodiment.

Referring to FIG. 19, a swirler 19 is provided in the burner system, and is gently bent in a vertical direction. Specifically, an agitator 191 is formed to three-dimensionally generate a plurality of swirls by compulsorily flowing the mixed gas in the mixing tube toward the top of the burner pot. According to the swirler 19, since swirls are generated upward at an internal space of the burner pot, occurrence of swirls may be facilitated by three-dimensionally using the internal space of the burner pot.

Eighth Embodiment

The eighth embodiment is identical to the fifth embodiment except for a swirler with a different shape. Therefore, the description for the identical component will be omitted for convenience.

Figure 20:
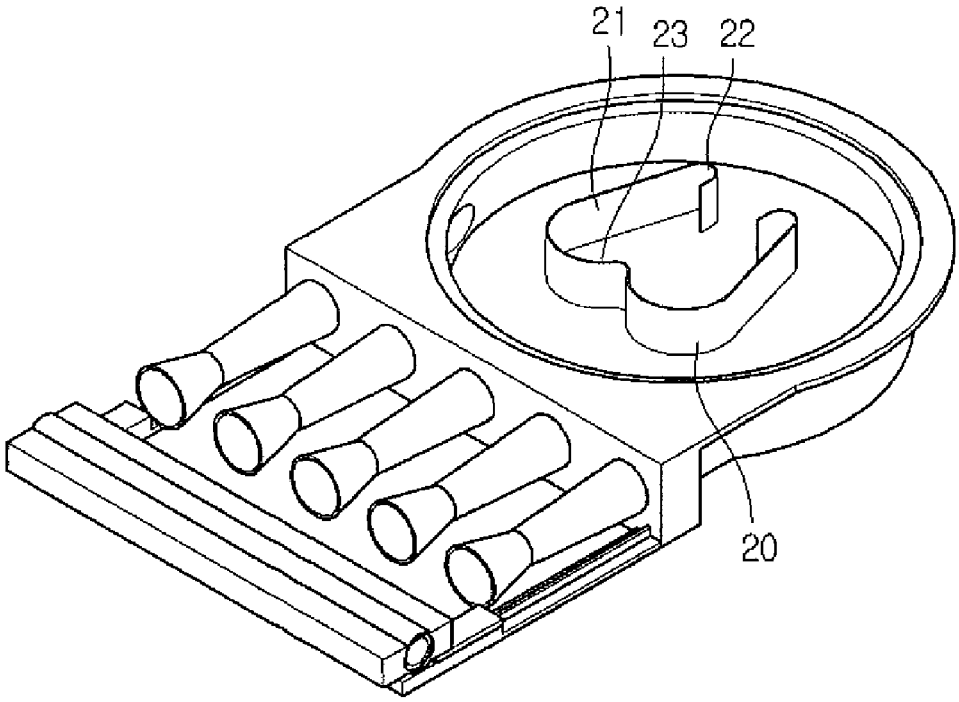
FIG. 20 is a perspective view of a burner system according to a eighth embodiment.

FIG. 20 is a perspective view of a burner system according to a eighth embodiment.

Referring to FIG. 20, the burner system includes a "W"-shaped swirler 20, and the both ends of the swirler 20 are gently bent toward the inside of the swirler 20.

According to the above shape, the mixed gas discharged from the mixing tubes at the outmost positions is guided toward the front of the burner pot through the flowing guide 21, and collides at the front of the burner pot to form a plurality of swirls. Specifically, the mixed gas injected from the mixing tube generates a plurality of swirls at the front of the swirler 20, that is, a space opposite to where the mixed gas collides. Additionally, a portion of the mixed gas is guided toward the internal space of the swirler 20 at the approximate middle of the burner pot by a middle guider 22, in order to generate a plurality of swirls. The mixed gas discharged from the three mixing tubes at the middle of the heating cooking appliance collides to form a plurality of swirls at an agitator 23 concave toward the front.

Here, the mixed gas, which is discharged from the internal mixing tubes between the mixing tubes at the outmost positions, collides with the swirler 20 and is guided toward the front of the swirler 20 or the center of the burner pot along the flowing guide 21. A portion of the mixed gas is guided toward the agitator 23 to generate swirls. For this, the swirler 20 may be aligned toward discharge ports 43 of the internal mixing tubes in front and rear directions.

The idea of the present disclosure is not limited to the above embodiments, and more embodiments can be suggested.

First, a predetermined insulating layer may be further provided between the contacting surfaces of the case and the burner pot. This may be applicable when a heat insulating operation of the burner pot cannot be performed, the thermal stability of the case is low, or additional components fragile to a heat are disposed on the bottom of the case.

Additionally, the exhaust unit is disposed on the rear by using the ceramic plate as a reference. However, the present disclosure is not limited to this, and the exhaust unit may be disposed on one edge of the ceramic plate. In this case, a user should be careful of getting burn through combustion gas. However, when the heating cooking appliance is installed at the corner of a kitchen, the exhaust unit may be formed on the side of the heating cooking appliance.

Additionally, swirlers with various forms may be provided to the present disclosure. The swirlers of the embodiments are not limited to a specific form, and more various forms can be applied to the present disclosure by adding technical properties of one swirler to another swirler. This is also is included in the spirit of the present disclosure.

Additionally, according to the above embodiment, the swirlers are applicable when the internal height of the burner pot is limited to a specific standard, but the present disclosure is not limited to this. Although the height of the burner pot varies, the swirler of the present disclosure can be applied to improve the uniform mixture of gas and air.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heating cooking appliance comprising:

a case;

a plate covering a top of the case;

a burner system within an interior defined by the plate and the case; and an exhaust unit disposed at a side edge of the case, wherein the burner system includes:

a burner pot having a vertical flat side and providing a single uniform mixing space for gas and air, a mixing tube unit extending from the vertical flat side of the burner pot, the mixing tube unit installed to supply a gas mixture into the single mixing space without leakage of the gas mixture; and a nozzle unit having a plurality of nozzles maintaining a predetermined distance from the mixing tube unit, wherein the mixing tube unit is provided with a plurality of mixing tubes, the plurality of mixing tubes communicate with the single mixing space, gas discharged from each nozzle and air are suctioned together into an inlet at one end of each mixing tube, and an outlet at the other end of each mixing tube communicates with one of a plurality of openings in the burner pot, the openings communicate with the single mixing space of the burner pot, and a mixture of the air suctioned together with the gas is discharged into the burner pot through the openings, the plurality of mixing tubes extending in the same direction from the vertical flat side of the burner pot, wherein the plurality of mixing tubes includes a first mixing tube and a second mixing tube, the first and second mixing tubes extending in a tangential direction of the burner pot, wherein the gas mixture discharged from the first mixing tube is whirled in a clockwise direction in the single uniform mixing space to form a first directional flow, wherein the gas mixture discharged from the second mixing tube is whirled in a counter-clockwise direction in the single uniform mixing space to form a second directional flow, and wherein the first and second directional flows are mixed in the single uniform mixing space.

2. The heating cooking appliance according to claim 1, wherein the burner system is provided in plurality.

3. The heating cooking appliance according to claim 1, wherein the mixing tube unit is provided with five mixing tubes.

4. The heating cooking appliance according to claim 2, wherein in the plurality of burner systems, in at least one of the burner systems, the extending direction of the mixing tubes is in a front-to-rear direction of the case, and in at least another one of the burner systems, the extending direction of the mixing tubes is in a rear-to-front direction of the case.

5. The heating cooking appliance according to claim 2, wherein the plurality of burner systems include:

two burner systems respectively provided on each side portion of the plate; and another burner system provided between the two burner systems.

6. The heating cooking appliance according to claim 5, wherein the another burner system is smaller than the two burner systems.

7. A heating cooking appliance comprising:

a case;

a plate covering a top of the case;

a burner system within an interior defined by the plate and the case; and an exhaust unit disposed at a side edge of the plate, wherein the burner system includes:

a burner pot having a vertical flat side and providing a single mixing uniform space for gas and air;

a mixing tube unit extending from the vertical flat side of the burner pot;

the mixing tube unit installed to supply a gas mixture into the single mixing space without leakage of the gas mixture; and a nozzle unit maintaining a predetermined distance from the mixing tube unit, wherein the mixing tube unit is provided with a plurality of mixing tubes, the plurality of mixing tubes is communicated with the single mixing space, gas discharged from the nozzle unit and air are suctioned together into an inlet at one end of each mixing tube, an outlet at the other end of each mixing tube communicates with an opening in the burner pot, the opening communicates with the single mixing space of the burner pot, and a mixture of the air suctioned together with the gas is discharged into the burner pot, and the opening has a height in a range of 1 to 0.8 times a height of the single mixing space, wherein the plurality of mixing tubes includes a first mixing tube and a second mixing tube, the first and second mixing tubes extending in a tangential direction of the burner pot, the gas and air in first mixing tube flow in the same direction as a flow direction of air and gas in the second mixing tube, wherein the gas mixture discharged from the first mixing tube is whirled in a clockwise direction in the single uniform mixing space to form a first directional flow, wherein the gas mixture discharged from the second mixing tube is whirled in a counter-clockwise direction in the single uniform mixing space to form a second directional flow, and wherein the first and second directional flows are mixed in the single uniform mixing space.

8. The heating cooking appliance according to claim 7, wherein the opening and the mixing tube have circular cross-section and have the same angle of expanding taper.

9. A burner system comprising:

a burner pot having a coupling part with a vertical side, the vertical side connected with a mixing tube unit, the burner pot providing at least a uniform mixing space for gas and air;

the mixing tube unit having a vertical side corresponding to the coupling part of the burner pot;

the mixing tube unit installed to supply a gas mixture into the mixing space without leakage of the gas mixture by being connected to the coupling part of the burner pot; and a nozzle unit maintaining a predetermined distance apart from the mixing tube unit, the nozzle unit supplying gas to the mixing tube unit, wherein the mixing tube unit includes a plurality of mixing tubes that extend in one direction from the coupling part of the burner pot, wherein the plurality of mixing tubes includes a first mixing tube, a second mixing tube, and at least one third mixing tube, the first and second mixing tubes are extended in a tangential direction of the burner pot, the at least one third mixing tube is provided between the first mixing tube and the second mixing tube, wherein the at least one third mixing tube is provided between the first mixing tube and the second mixing tube, wherein the gas mixture discharged from the first mixing tube is whirled in a clockwise direction in the uniform mixing space to form a first directional flow, wherein the gas mixture discharged from the second mixing tube is whirled in a counter-clockwise direction in the uniform mixing space to form a second directional flow, and wherein the first and second directional flows are mixed in the uniform mixing space.

10. The burner system according to claim 9, wherein the mixing tubes are simultaneously coupled to the nozzle unit in a single coupling process.

11. The burner system according to claim 9, wherein the mixing tube unit is fastened to the burner pot, with the plurality of mixing tubes fixed to the mixing tube unit.

12. The burner system according to claim 9, wherein the centers of the cross sectional area of the mixing tubes are disposed on the same line.

13. The burner system according to claim 9, wherein inlets of the mixing tubes are aligned, and the nozzle unit is formed in a straight shape according to the aligned inlets.

14. A heating cooking appliance comprising:

a case;

a plate covering a top surface of the case, a burner system in an internal space of the plate and the case, and an exhaust unit on one side of the plate, wherein the burner system includes:

a burner pot having a coupling part, the coupling part having a vertical side connected with a mixing tube unit, the burner pot providing a single uniform mixing space for gas with air, the mixing tube unit having a vertical side corresponding to the coupling part of the burner pot;

the mixing tube unit installed to supply a gas mixture into the single mixing space without leakage of the gas mixture by being connected to the coupling part of the burner pot;

a glow plate on a top of the burner pot, a mixing pipe unit leading gas and air to an inside of the burner pot, and a nozzle unit spaced a predetermined distance apart from the mixing pipe unit, the burner pot having an internal height of 18 to 30 mm, wherein the mixing tube unit is provided with a plurality of mixing tubes, the plurality of mixing tubes communicating with the single mixing space, wherein the plurality of mixing tubes includes a first mixing tube and a second mixing tube, the first and second mixing tubes extending in a tangential direction of the burner pot, wherein the gas mixture discharged from the first mixing tube is whirled in a clockwise direction in the single uniform mixing space to form a first directional flow, wherein the gas mixture discharged from the second mixing tube is whirled in a counter-clockwise direction in the single uniform mixing space to form a second directional flow, and wherein the first and second directional flows are mixed in the single uniform mixing space.

15. The heating cooking appliance according to claim 14, further comprising a swirler for uniformly mixing air with gas in the inside of the burner pot.

16. The heating cooking appliance according to claim 15, wherein at least a portion of the swirler is rounded or bent toward a top of the burner pot to agitate.

17. The heating cooking appliance according to claim 15, wherein the swirler is fixed at an internal bottom surface of the burner pot.

18. The heating cooking appliance according to claim 15, wherein the swirler extends from one portion to the other portion in the inside of the burner pot, has a plurality of inflection points.

19. The heating cooking appliance according to claim 15, wherein the swirler has a "V" shape.

20. The heating cooking appliance according to claim 19, wherein the swirler is extended wider and is extended toward a direction where the mixing pipe is disposed and is extended.

21. The heating cooking appliance according to claim 15, wherein the swirler has a "W" shape.

22. The heating cooking appliance according to claim 21, wherein the swirler comprises an end part that is smoothly bent toward a center of the burner pot.

23. A burner system comprising:

a plurality of nozzles injecting gas;

a plurality of mixing tubes mixing air with the gas injected from the nozzles;

a burner pot having a coupling part, the coupling part having a vertical side connected with a mixing tube, the burner pot providing a single uniform mixing space for gas and air;

the mixing tube unit having a vertical side corresponding to the coupling part of the burner pot;

the mixing tube unit installed to supply a gas mixture into the single mixing space without leakage of the gas mixture by being connected to the coupling part of the burner pot;

the nozzle maintaining a predetermined distance apart from the mixing tube; and a swirler inside the single mixing space of the burner pot, the swirler facilitating a mixture of gas with air even if a gas injecting speed changes, wherein the burner pot has a circular shape and provides the single mixing space for uniformly mixing gas with air injected from the mixing tubes, a plurality of mixing tubes is communicated with the single mixing space, wherein the plurality of mixing tubes includes a first mixing tube and a second mixing tube, the first and second mixing tubes extending in a tangential direction of the burner pot, wherein the gas mixture discharged from the first mixing tube is whirled in a clockwise direction in the single uniform mixing space to form a first directional flow, wherein the gas mixture discharged from the second mixing tube is whirled in a counter-clockwise direction in the single uniform mixing space to form a second directional flow, and wherein the first and second directional flows are mixed in the single uniform mixing space.

* * * * *